United States Patent [19]

Shibagaki et al.

[11] Patent Number: 4,873,723

[45] Date of Patent: Oct. 10, 1989

[54] METHOD AND APPARATUS FOR MULTI-PULSE SPEECH CODING

[75] Inventors: Kouichi Shibagaki; Akira Fukui, both of Tokyo, Japan

[73] Assignee: NEC Corporation, Japan

[21] Appl. No.: 97,524

[22] Filed: Sep. 16, 1987

[30] Foreign Application Priority Data

Sep. 18, 1986 [JP] Japan ..... 61-221307

[51] Int. Cl.[4] ..... G10L 3/02

[52] U.S. Cl. ..... 381/34; 381/36

[58] Field of Search ..... 381/31, 34, 35, 36; 364/513.5

[56] References Cited

U.S. PATENT DOCUMENTS 4,486,899 12/1984 Fushikida ..... 381/36

FOREIGN PATENT DOCUMENTS 1197619 12/1985 Canada ..... 381/34

OTHER PUBLICATIONS

Atal et al. of Bell Telephone Labs. of the U.S., "A New Model of LPC Excitation for Producing Natural--Sounding Speech at Low Bit Rates", Proc. ICASSP, pp. 614–617, 1982.

Ozawa et al., "Multi-Pulse Excited Speech Coder Based on Maximum Cross Correlation Search Algorithm", IEEE Global Telecommunications Conference, 23.3, Dec. 1983.

Ozawa et al., "High Quality Multi-Pulse Speech Coder with Pitch Prediction", Proc. ICASSP, 33.3, Apr. 1986.

*Primary Examiner*—William M. Shoop, Jr.

*Assistant Examiner*—Marc S. Hoff

*Attorney, Agent, or Firm*—Laff, Whitesel, Conte & Saret

[57] ABSTRACT

A multi-pulse speech coder uses synthetic filters for generating crosscorrelated signals without pitch prediction and autocorrelated signals with pitch prediction. These signals are used as a basis for calculations to detect the correlations between the signals with pitch predictions and input speech signals.

12 Claims, 4 Drawing Sheets

METHOD AND APPARATUS FOR MULTI-PULSE SPEECH CODING

BACKGROUND OF THE INVENTION

The present invention relates to a method for multi-pulse coding a speech signal and an apparatus for performing the encoding.

A multi-pulse speech coding method (hereinafter referred to simply as a "multi-pulse method") is available for coding a speech signal at a bit rate which is lower than 16 kilobits per second. This system offers high product speech quality, as proposed by Atal et al of Bell Telephone Laboratories of the Unitd States, in "A NEW MODEL OF LPC EXCITATION FOR PRODUCING NATURAL-SOUNDING SPEECH AT LOW BIT RATES," Proc. ICASSP, pp. 614∝617, 1982. Specifically, a multi-pulse method is such that a synthetic filter is excited by an excitation pulse sequence which is constituted by a plurality of pulses that are different in amplitude and location from each other, thereby synthesizing a speech. The principle of multi-pulse coding will be described with reference to FIG. 1.

In FIG. 1, an excitation generator 101 generates multi-pulse excitation v(n). A synthetic filter 102 is excited by the multi-pulse excitation v(n) to produce a synthetic speech $\tilde{x}(n)$. To perceptually correct an error e(n) between the original and the synthetic speeches x(n) and x(n), respectively, the error e(n) is fed through a weighting filter 103. Then, the output of the weighting filter 103, i.e., weighted error signal $e_w(n)$, is fed back to the excitation generator 101 to minimize the power of the signal $e_w(n)$. This provides optimum multi-pulse excitation v(n).

In the multi-pulse method outlined above, the result of an excitation pulse search determined the characteristic of the entire system. Atal et al propose an A-b-S (Analysis-by-Synthesis) procedure as a pulse search method, in the previously mentioned paper. However, a problem with the A-b-S procedure is that, because an excitation pulse train is determined one pulse at a time so as to minimize the error power between an original and a synthetic speech signal as stated earlier, the procedure requires a calculation of an amount which is too great to be implemented with a signal processor.

To reduce the amount of calculations, Ozawa et al has proposed a method which performs a pulse search in a correlation domain ("MULTI-PULSE EXCITED SPEECH CODER BASED ON MAXIMUM CROSS-CORRELATION SEARCH ALGORITHM," IEEE Global Telecommunications Conference, 23.3, December 1983). The proposed method implements pulse search with a signal processor, as described hereinafter.

Assuming that the frame whose pulse sequence is to be determined has a length of N samples, and that K pulses are to be determined, the excitation signal v(n) may be expressed as:

$$v(n) = \sum_{i=1}^{K} g_i \cdot \delta(n - m_i) \qquad \text{Eq. (1)}$$

$$(0 \leqq n \leqq N - 1)$$

where $g_i$ is the amplitude of the i-th pulse, $m_i$ is the location of the i-th pulse, and δ(n) is δ of Kronecker.

The synthetic speech $\tilde{x}(n)$ is produced by exciting a synthetic filter by the excitation signal v(n) as represented by the Eq. (1). Therefor, it may be expressed as:

$$\tilde{x}(n) = \sum_{i=1}^{K} g_i \cdot h(n - m_i) \qquad \text{Eq. (2)}$$

where h(n) is representative of the impulse response of the synthetic filter.

The weighted error $e_w(n)$, obtained by perceputally weighting the error between the original and synthetic speeches, is produced by:

$$e_w(n) = [x(n) - \tilde{x}(n)] * w(n) \qquad \text{Eq. (3-1)}$$

$$= \left[ x(n) - \sum_{i=1}^{K} g_i \cdot h(n - m_i) \right] * w(n) \qquad \text{Eq. (3-2)}$$

where w(n) is the perceptual weighting function, and * stands for convulution integration.

As regards the weighted error power E, because it is obtainable by integrating the weighted error $e_w(n)$, it may be expressed as:

$$E = \sum_{n=1}^{N} e_w^2(n) \qquad \text{Eq. (4-1)}$$

$$= \sum_{n=1}^{N} \left[ \left\{ x(n) - \sum_{i=1}^{K} g_i \cdot h(n - m_i) \right\} * w(n) \right]^2 \qquad \text{Eq. (4-2)}$$

Because an excitation pulse sequence is determined to minimize the weighted error power E, the location $m_k$ and the amplutide $g_k$ of the k-th pulse are obtained from an equation which is produced by setting the Eq. (4-2) with respect to the k-th amplutide $g_k$ to zero. The resultant pulse location $m_k$ and pulse amplitude $g_k$ are given by the following Eq. (5):

$$g_k = \frac{\phi hx(m_k) - \sum_{l=1}^{K-1} g_l \cdot Rhh(|m_l - m_k|)}{Rhh(0)} \qquad \text{Eq. (5)}$$

where $$\phi hx(m) = \sum_{n=0}^{N-1} x_w(n) \cdot h_w(n - m) \qquad \text{Eq. (6-1)}$$

$$(0 \leqq m \leqq N - 1)$$

$$Rhh(m) = \sum_{n=0}^{N-1} h_w(n) \cdot h_w(n - m) \qquad \text{Eq. (6-2)}$$

$$(0 \leqq m \leqq L - 1)$$

Here, $x_w(n)$ is the weighted speech produced by applying perceptual weighting to the original speech x(n), $h_w(n)$ is the weighted impulse response of the synthetic filter, and L is the sample length (time) of the weighted impulse response.

They may be expressed by using the impulse response of the weighting filter as follows:

$$x_w(n) = x(n) * w(n) \qquad \text{Eq. (6-3)}$$

$$h_w(n) = h(n) * w(n) \qquad \text{Eq. (6-4)}$$

where $\phi hx(m)$ is representative of crosscorrelation between $x_w(n)$ and $h_w(n)$ and Rhh(m), autocorrelation of $h_w(n)$.

It is to be noted that crosscorrelation is a function which is representative of a correlation between two signal sequences. Autocorrelation is a function which is representative of how much a signal waveform deviated by a certain time $\tau$ from an original waveform resembles (correlates to) the latter.

The pulse search procedure which is based on the Eq. (5) will be described next. At the beginning, cross-correlation $\phi hx(m)$ and autocorrelation Rhh(m) are determined. The numerator of the Eq. (5) is selected to be the criterion function $R(m_k)$ of error.

The location of the first pulse is $m_1$ at which the absolute value of the criterion function $R(m_1)$ is maximum. The amplutide $g_1$ of the first pulse is obtained by substituting the pulse location $m_1$ for the Eq. (5). Then, by substituting 2 fork of the Eq. (5), a criterion function $R(m_2)$ which is free from the influence of the first pulse is determined. Subsequently, based on the criterion function $R(m_2)$, the loction $m_2$ and the amplitude $g_2$ of the second pulse are determined in a manner which is the same as the manner which is used to determine the location and amplitude of the first pulse. Such a procedure is repeated a number of times which is the same as the number of pulses required to determine an excitation pulse sequence.

FIG. 2 shows a specific construction for a pulse search circuit. A speech signal x(n) is applied to a weighting filter 201 to produce a weighted speech signal $x_w(n)$. On the other hand, LPC (linear prediction coding) parameters are fed to a weighted impulse-response calculator 202 to determine a weighted impulse response $h_w(n)$. Next, the weighted speech signal $x_w(n)$ and the weighted impulse response $h_w(n)$ are routed to a crosscorrelation calculator 203 to produce their crosscorrelation $\phi hx(m)$. At the same time, the weighted input response $h_w(n)$ is fed to a autocorrelation calculator 204 to determine its autocorrelation Rhh(m). Finally, the crosscorrelation $\phi hx(m)$ and the autocorrelatin Rhh(m) are delivered to a pulse search block 205 which performs pulse search for determining pulse locations $m_k$ and pulse amplitudes $g_k$, which define an excitation pulse sequence.

In multi-pulse speech coding, a decrease in the bit rate leads to a decrease in the number of pulses which in turn impairs the sound quality. In the light of this, Ozawa et al have proposed a method of lowering the bit rate while allowing a minimum deterioration of quality to occur. The lowering of the bit rate is aided by the pitch periodicity in a voiced section of a speech signal ("HIGH QUALITY MULTI-PHASE SPEECH CODER WITH PITCH PREDICTION," Proc. ICASSP, 33.3, April 1986).

In accordance with this method, a synthetic filter is represented by a cascaded connection of a pitch prediction filter for reproducing a pulse sequence by use of a pulse sequence which occurred one pitch period before, and of a specturm envelope synthetic filter for reproducing a speech waveform. That is, pitch information is included in the impulse response of a synthetic filter. In the previously discussed multi-pulse coding which does not use pitch information, only the spectrum envelope synthetic filter is used as the synthetic filter. The method mentioned above successfully reduces the number of excitation pulses needed to excite the pitch prediction filter. Therefore, the method also reduces the number of pulses to be transmitted, as compared to a circuit wherein a pitch prediction filter is not used.

Nevertheless, the above described method of the kind using pitch information needs a synthetic filter having impulse response length which is several times greater than in the method which does not perform pitch prediction. Thus, the pitch periodicity may be represent by the impulse reponse of the synthetic filter.

This brings about a problem because the method of pulse search with pitch prediction requires a considerably greater amount of calculation than the method without pitch prediction, i.e., the calculation of autocorrelation of impulse response of a synthetic filter and the calculation of a crosscorrelation between the impulse response of a synthetic filter and an input speech signal.

The principle of multi-pulse coding which uses pitch information will be described with reference to FIG. 3. As shown in FIG. 3, an excitation generator 301 generates multi-pulse excitation v(n). A pitch prediction filter 302 is excited by the multi-pulse excitation v(n) to output an excitation pulse sequence v'(n). The excitation pulse sequence v'(n) excites a spectrum envelope synthetic filter 303 to produce a synthetic speech $\bar{x}(n)$. The error e(n) between an original speech x(n) and the synthetic speech $\bar{x}(n)$ is applied to a weighting filter 304 which is adapted for perceptual correction. The resultant weighted error signal $e_w(n)$ is fed back to the excitation generator 301 to minimize the power of the signal $e_w(n)$, whereby an optimum multi-pulse excitation v(n) is determined.

An object of the present invention is to provide multi-pulse speech coding which uses pitch information. The inventive method and apparatus for multi-pulse speech coding enables pitch prediction to be performed with a minimum amount of calculation required for the calculation of autocorrelation of impulse response of a synthetic filter and crosscorrelation between the impulse response of a synthetc filter and an input spech signal. The invention utilizes the periodicity of pitch.

SUMMARY OF THE INVENTION

A method and an apparatus for multi-pulse speech coding of the present invention comprises a means for adding crosscorrelations between an impulse response of a synthetic filter without pitch prediction and an impulse response of a synthetic filter with pitch prediction. This determines autocorrelations of the impulse response of the synthetic filter with pitch prediction. The crosscorrelations between the impulse response of the synthetic filter without pitch prediction and an input speech signal are added to determine crosscorrelations between the impulse response of the synthetic filter with pitch prediction and the input speech signal.

BRIEF DESCRIPTION OF THE DRAWINGS

In the drawings, the same reference numerals denote respectively the same structural elements.

DETAILED DESCRIPTION OF THE PREFERRED EMBODIMENT

Figure 1:
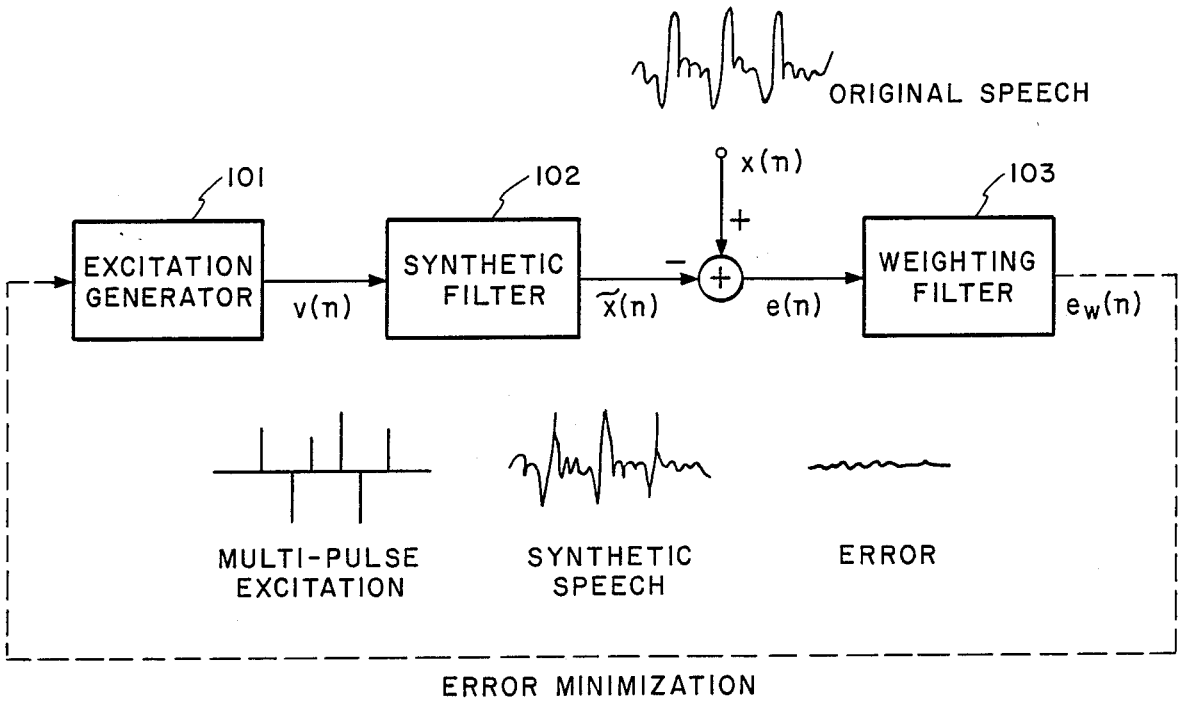
FIG. 1 PRIOR ART
FIG. 1 is a block diagram showing the principle of multi-pulse coding.
Figure 2:
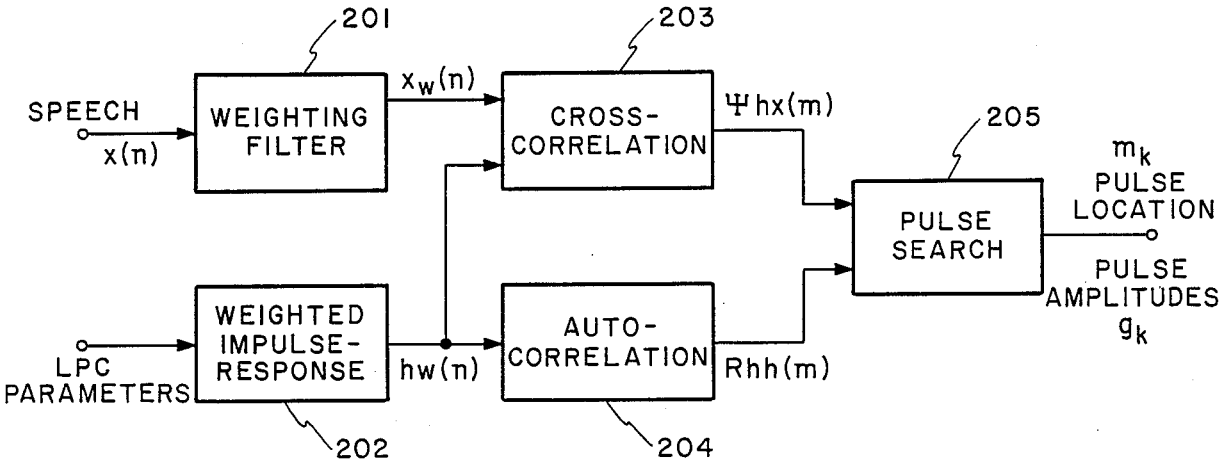
FIG. 2 PRIOR ART
FIG. 2 is a block diagram of a pulse search procedure.
Figure 3:
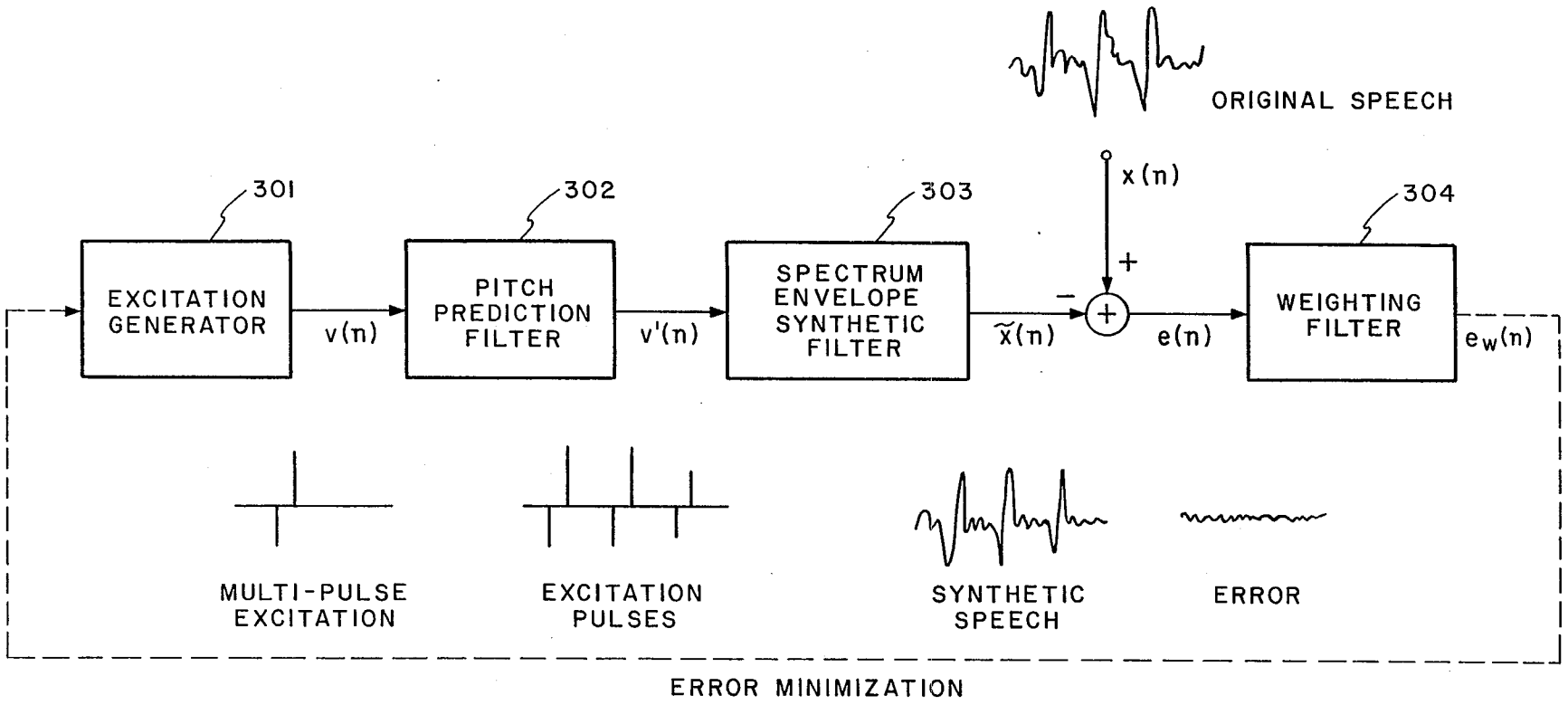
FIG. 3 PRIOR ART
FIG. 3 is a block diagram showing the principle of multi-pulse coding which uses pitch information.
Figure 4:
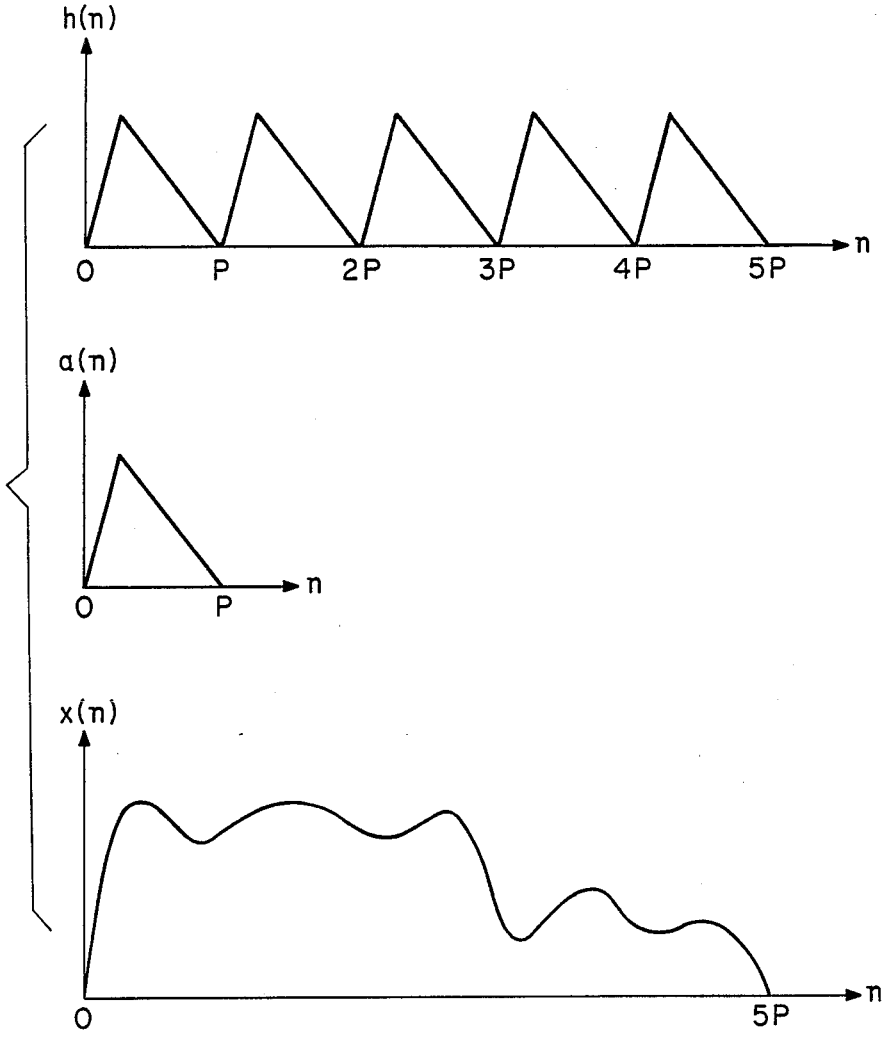
FIG. 4 shows plots which are representative of the principle of the present invention.

FIG. 4 shows graphic plots which are representative of the principle of the present invention. In the figure, h(n) is the impulse response of the synthetic filter with pitch prediction, a(n) is the impulse response of a synthetic filter without pitch prediction, x(n) is an input speech signal, and P is a pitch period. As regards a synthetic filter with pitch prediction, the autocorrelation Rhh(k) of impulse response h(n) is obtainable by suitably adding crosscorrelation $\phi$ha(n) between the impulse response h(n) of the synthetic filter with pitch prediction and the impulse response a(n) of a synthetic filter without pitch prediction. How such autocorrelation is determined will be explained hereinafter with reference to FIG. 4.

The autocorrelation Rhh(k) of the impulse response h(n) which is accompanied with pitch prediction is expressed as:

$$Rhh(k) = \sum_{n=k}^{5p-1} h(n)h(n-k) \qquad \text{Eq. (7)}$$

Because the impulse response h(n) of the synthetic filter with pitch prediction has pitch periodicity, it may be represented by using the impulse response a(n) of the synthetic filter wihtout pitch prediction, as follows:

$$h(n)=a(n)+(n-p)+a(n-2p)+a(n-3p)+a(n-4p) \qquad (8)$$

If follows that the autocorrelation Rhh(k) of impulse response h(n) of the synthetic filter with pitch prediction is given by:

$$Rhh(k) = \sum_{n=k}^{k+p-1} h(n)a(n-k) + \sum_{n=k+p}^{k+2p-1} h(n)a(n-k-p) + \sum_{n=k+2p}^{k+3p-1} h(n)a(n-k-2p) + \sum_{n=k+3p}^{k+4p-1} h(n)a(n-k-3p) + \sum_{n=k+4p}^{5p-1} h(n)a(n-k-4p) \qquad \text{Eq. (9-1)}$$

$$0 \leqq k \leqq p-1$$

$$Rhh(k) = \sum_{n=k}^{k+p-1} h(n)a(n-k) + \sum_{n=k+p}^{k+2p-1} h(n)a(n-k-p) + \sum_{n=k+2P}^{k+3p-1} h(n)a(n-k-2p) + \sum_{n=k+3p}^{5p-1} h(n)a(n-k-3p) \qquad \text{Eq. (9-2)}$$

$$p \leqq k \leqq 2p-1$$

$$Rhh(k) = \sum_{n=k}^{k+p-1} h(n)a(n-k) + \sum_{n=k+p}^{k+2p-1} h(n)a(n-k-p) + \sum_{n=k+2p}^{5p-1} h(n)a(n-k-2p) \qquad \text{Eq. (9-3)}$$

$$2p \leqq k \leqq 3p-1$$

$$Rhh(k) = \sum_{n=k}^{k+p-1} h(n)a(n-k) + \sum_{n=k+p}^{5p-1} h(n)a(n-k-p) \qquad \text{Eq. (9-4)}$$

$$3p \leqq k \leqq 4p-1$$

-continued $$Rhh(k) = \sum_{n=k}^{5p+1} h(n)a(n-k) \qquad \text{Eq. (9-5)}$$

$$4p \leqq k \leqq 5p-1$$

Here, the crosscorrelations $\phi$ha(k), $\phi$ha(k+p), $\phi$ha(k+2p), $\phi$ha(k+3p) and $\phi$ha(k+4p) between the impulse response h(n) of the synthetic filter with pitch prediction and the impulse response a(n) of the synthetic filter without pitch prediction are individually expressed as:

$$\phi ha(k) = \sum_{n=k}^{k+p-1} h(n)a(n-k) \quad 0 \leqq k \leqq 4p-1 \qquad \text{Eq. (10-1)}$$

$$= \sum_{n=k}^{5p-1} h(n)a(n-k) \quad 4p \leqq k \leqq 5p-1$$

$$\phi ha(k+p) = \sum_{n=k+p}^{k+2p-1} h(n)a(n-k-p) \qquad \text{Eq. (10-2)}$$

$$0 \leqq k \leqq 3p-1$$

$$= \sum_{n=k+p}^{5p-1} h(n)a(n-k-p)$$

$$3p \leqq k \leqq 4p-1$$

$$\phi ha(k+2p) = \sum_{n=k+2p}^{k+3p-1} h(n)a(n-k-2P) \qquad \text{Eq. (10-3)}$$

$$0 \leqq k \leqq 2p-1$$

$$= \sum_{n=k+2p}^{5p-1} h(n)a(n-k-2p)$$

$$2p \leqq k \leqq 3p-1$$

$$\phi ha(k+3p) = \sum_{n=k+3p}^{k+4p-1} h(n)a(n-k-3p) \qquad \text{Eq. (10-4)}$$

$$0 \leqq k \leqq p-1$$

$$= \sum_{n=k+3p}^{5p-1} h(n)a(n-k-3p)$$

$$p \leqq k \leqq 2p-1$$

$$\phi ha(k+4p) = \sum_{n=k+4P}^{5p-1} h(n)a(n-k-4p) \qquad \text{Eq. (10-5)}$$

$$0 \leqq k \leqq p-1$$

Then, the autocorrelation Rhh(k) of impulse response h(n) of the synthetic filter with pitch prediction may be expressed by using the crosscorrelation $\phi$ha(k) between that impulse reponse h(n) and the impulse response a(n) of the synthetic filter without pitch prediction, as follows:

$$Rhh(k) = \phi ha(k) + \phi ha(k+p) + \phi ha(k+2p) + \phi ha(k+3p) + \phi ha(k+4p) \qquad \text{Eq. (11-1)}$$

$$0 \leqq k \leqq p-1$$

$$Rhh(k) = \phi ha(k) + \phi ha(k+p) + \phi ha(k+2p) + \phi ha(k+3p) \qquad \text{Eq. (11-2)}$$

$$p \leqq k \leqq 2p-1$$

$$Rhh(k) = \phi ha(k) + \phi ha(k+p) + \phi ha(k+2p) \qquad \text{Eq. (11-3)}$$

$$2p \leqq k \leqq 3p-1$$

$$Rhh(k) = \phi ha(k) + \phi ha(k+p) \qquad \text{Eq. (11-4)}$$

-continued $$3p \leqq k \leqq 4p - 1$$

$$Rhh(k) = \phi ha(k) \qquad \text{Eq. (11-5)}$$

$$4p \leqq k \leqq 5p - 1$$

Therefore, the autocorrelation Rhh(k) of the impulse response of the synthetic filter, with pitch prediction, can be determined by calculating the crosscorrelation $\phi$ha(k) between the impulse response h(n) of that synthetic filter and the impulse response a(n) of the synthetic filter without pitch prediction. Then, the impulse responses with and without pitch prediction are added together. This reduces the required amount of calculation, as compared to the system which directly determines the autocorrelation Rhh(k).

Likewise, the crosscorrelation $\phi$hx(k) between the impulse response h(n) of the synthetic filter with pitch prediction and the input speech signal x(n) may be expressed by using the crosscorrelation $\phi$ax(k) between the impulse response a(n) of the syntehtic filter without pitch prediction and the input speech signal x(n), as follows:

$$\phi hx(k) = \phi ax(k) + \phi ax(k+p) + \phi ax(k+2p) + \phi ax(k+3p) + \phi ax(k+4p) \qquad \text{Eq. (12-1)}$$

$$0 \leqq k \leqq p - 1$$

$$\phi hx(k) = \phi ax(k) + \phi ax(k+p) + \phi ax(k+2p) + \phi ax(k+3p) \qquad \text{Eq. (12-2)}$$

$$p \leqq k \leqq 2p - 1$$

$$\phi hx(k) = \phi ax(k) + \phi ax(k+p) + \phi ax(k+2p) \qquad \text{Eq. (12-3)}$$

$$2p \leqq k \leqq 3p - 1$$

$$\phi hx(k) = \phi ax(k) + \phi ax(k+p) \qquad \text{Eq. (12-4)}$$

$$3p \leqq k \leqq 4p - 1$$

$$\phi xh(k) = \phi ax(k) \qquad \text{Eq. (12-5)}$$

$$4p \leqq k \leqq 5p - 1$$

Hence, the crosscorrelatin $\phi$hx(n) between the impusle response h(n) of the synthetic filter with pitch prediction and the input speech signal x(n) can be produced by determining the crosscorrelation $\phi$ax(n) between the impulse response a(n) of the synthetic filter without pitch prediction and the input speech signal x(n). Then, the responses of the filter and the input speech are added together. Again, this cuts down the amount of calculation, as compared to the case wherein the crosscorrelation $\phi$hx(n) is directly determined. While the impulse response length of the synthetic filter with pitch prediction has been assumed in the above description as being an integral multiple of pitch period, such an assumption is made for the simplicity of the description only and may not be an integral multiple. Although the impulse response length of the synthetic filter without pitch prediction has been shown and described as being equal to a pitch period, it may be longer or shorter than a pitch period. Further, the length of an input speech signal which has been assumed to be equal to the impulse response length of the synthetic filter with pitch prediction may also be longer or shorter than the impulse response length.

Figure 6:
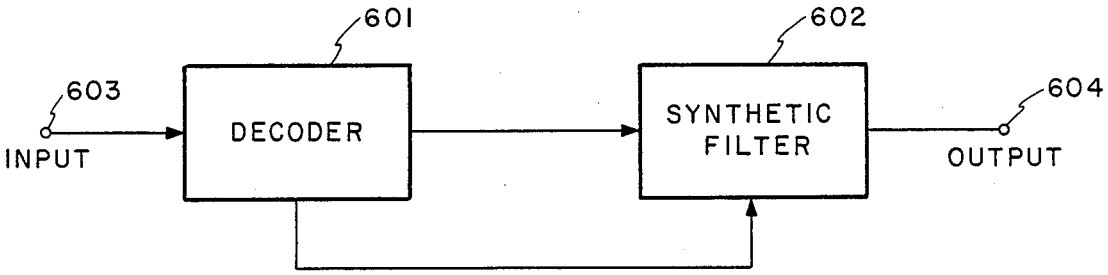
FIG. 6 is a block diagram showing a decoding side of one embodiment of the invention.
Figure 5:
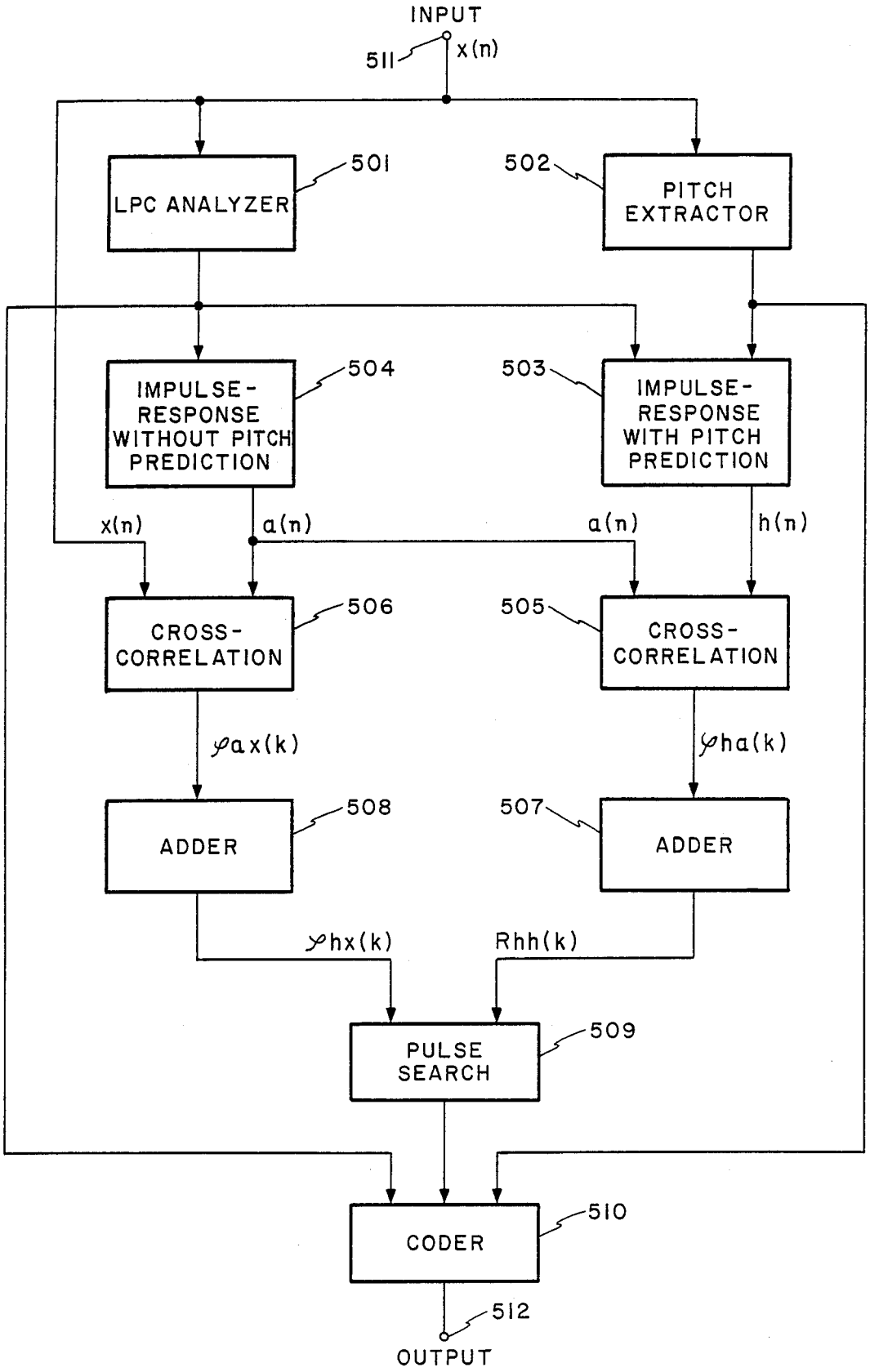
FIG. 5 is a block diagram showing a coding side of one embodiment of the present invention.

The principle of the present invention, as described above, may be implemented with the constructions shown in FIG. 5 and 6.

In FIG. 5, a coding side in accordance with the present invention comprises a linear predictive coding (LPC) analyzer 501, a pitch extractor 502, an impulse-response with pitch prediction calculator 503, an impulse-response without pitch prediction calculator 504, crosscorrelation calculators 505 and 506, adders 507 and 508, a pulse search block 509, and a coder 510. On the other hand, as shown in FIG. 6, a decoding side in accordance with the present invention comprises a decoder 601 and a synthetic filter 602.

The operation of the coding side will be described with reference to FIG. 5. An input speech signal x(n) coming in through an input terminal 511 is fed to the LPC analyzer 501, pitch extractor 502, and crosscorrelation calculator 506. The LPC analyzer 501 performs an LPC analysis on the speech signal x(n) to determine the filter coefficients. The filter coefficients are applied to the impulse response with pitch prediction calculator 503, impulse response without pitch prediction calculator 504, and coder 510.

The pitch extractor 502 extracts a pitch period from the speech signal x(n) and feeds it to the impulse response with pitch prediction calculator 503 and coder 510. The calculator 503 calculates an impulse response h(n) of a synthetic filter with pitch prediction by using the filter coefficients as determined by the LPC analyser 501 and the pitch period as extracted by the pitch extractor 502. The impulse response h(n) is applied to the crosscorrelation calculator 505. The calculator 504 produces an impulse response a(n) of a synthetic filter without pitch prediction from the filter coefficients and delivers the prediction to the crosscorrelation calculators 505 and 506. Receiving the impulse response h(n) and a(n) of the synthetic filters with and without prediction, respectively, the crosscorrelation calculator 505 determine crosscorrelations $\phi$ha(k) to $\phi$ha(k+4p) as represented by the previous Eq. (10-1) to (10-5) and feed them to the adder 507. The adder 507 in turn adds together the individual crosscorrelations, as represented by the Eqs. (11-1) to (11-5) to produce autocorrelations Rhh(k) of impulse response of the synthetic filter with pitch prediction. The autocorrelations Rhh(k) are fed to the pulse search block 509.

The crosscorrelation calculator 506 calculates crosscorrelations $\phi$ax(k) between the impulse response a(n) of the synthetic filter without pitch prediction and the input speech signal x(n), feeding them to the adder 508. Adding the input crosscorrelations $\phi$ax(k) as represented by the Eqs. (12-1) to (12-5), the adder 508 produces crosscorrelations $\phi$hx(k) between the impulse response h(n) of the synthetic filter with pitch prediction and the speech signal x(n). The crosscorrelations $\phi$hx(k) are applied to the pulse search block 509. The pulse search block 509 searches pulses in the correlations domain based on the autocorrelations Rhh(k) and the crosscorrelations $\phi$hx(k), thereby determining a plurality of pulses for exciting the synthetic filter. Such pulse information is routed to the coder 510. The coder 510 encodes the pulse information, the filter coefficients output by the LPC analyzer 501, and the pitch informaiton output by the pitch extractor 502 and, then, applies them to an output terminal 512.

As shown in FIG. 6, the decoding side receives at its input terminal 603 the filter coefficients, pitch information and pulse information which have been coded as stated above. The filter coefficients, pitch information and pulse information are fed to the decoder 601 to be decoded thereby. The decoded filter coefficients and pitch iformation are routed to the synthetic filter 602. The decoded pulse information is routed to the synthetic filter 602 to excite it in order to reproduce a speech signal. The reproduced speech signal is applied to an output terminal 604.

What is claimed is:

1. In multi-pulse coding of a speech signal, a method of reducing the amount of calculation that is necessary for conducting a pulse search, said method comprising the steps of:

adding crosscorrelations between an impulse response of a synthetic filter without pitch prediction and an impulse response of a synthetic filter with pitch prediction, thereby determining autocorrelations of the impulse response of said synthetic filter with pitch prediction; and adding crosscorrelations between the impulse response of said synthetic filter without pitch prediction and an input speech signal to determine crosscorrelations between the impulse reponse of said synthetic filter with pitch prediction and the input speech signal.

2. A multi-pulse speech coder comprising:

a pitch extracting means for extracting a pitch period from an input speech signal;

a linear predictive coding analyzig means responsive to said extracting means for determing coefficients of a synthetic filter by applying linear predictive coding analysis to the input speech signal;

a first impulse response calculating means jointly responsive to said extracting means and said analyzing means for calculating an impulse response of a synthetic filter with pitch prediction based on the pitch period as extracted by said pitch extracting means and the coefficients as determined by said linear predictive coding analyzing means;

a second impulse response calculating means responsive to said analyzing means for calculating an impulse response of a synthetic filter without pitch prediction based on the coefficients as determined by said linear predictive coding analyzing means;

a first crosscorrelation calculating means jointly responsive to said input speech signal and said second impulse response calculating means for calculating crosscorrelations between the impulse response of said synthetic filter with pitch prediction output by said first impulse response calculating means and the impulse response of said synthetic filter without pitch prediction output by said second impulse response calculating means;

a first adding means responsive to said first crosscorrelation calculating means for adding the crosscorrelations as calculated by said first crosscorrelation calculating means to produce autocorrelations of the impulse response of said synthetic filter with pitch prediction;

a second crosscorrelation calculating means jointly responsive to said second impulse response calculating means and the input speech signal for calculating crosscorrelations between the impulse response of said synthetic filter without pitch prediction output by said second impulse response calculating means and the input speech signal;

a second adding means jointly responsive to said second crosscorrelation calculating means and the input signal for adding the crosscorrelations as calculated by said second crosscorrelation calculating means to produce crosscorrelations between the impulse response of said synthetic filter with pitch prediction and the input speech signal; and a pulse search means jointly responsive to said first and second adding means for searching for a plurality of pulses for exciting a synthetic filter based on the autocorrelations output by said first adding means and the crosscorrelations output by said second adding means.

3. A multi-pulse speech coder in accordance with claim 2, further comprising a coding means for coding pulse information output by said pulse searching means, the filter coefficients output by said linear predictive coding analyzing means, and pitch information output by said pitch extracting means.

4. A multi-pulse speech coder comprising:

impulse producing means responsive to the receipt of input speech signals for generating crosscorrelated signals without pitch prediction, impulse producing means responsive to the receipt of parameter signals for generating autocorrelation signals with pitch prediction, and means jointly responsive to said crosscorrelated signals and to said input speech signal to detect correlations between said signals with pitch prediction and input speech signals.

5. The coder of claim 4, wherein, each of said impulse producing means is a synthetic filter.

6. The coder of claim 4 wherein said jointly responsive means adds said signals with pitch prediction and said input speech signals.

7. The coder of claim 5 further comprising means for extracting pitch periods from said input speech and linear predictive code analyzing means responsive to said extracting means for generating coefficients for at least one of said synthetic filters, and means responsive to said analyzing means for operating said impulse producing means with pitch prediction.

8. The coder of claim 7, wherein said jointly responsive means adds said signal with pitch prediction and said input speech signal.

9. The coder of claim 7 wherein said jointly responsive means calculates the crosscorrelations between the responses of said synthetic filter with pitch prediction and said synthetic filter without pitch prediction.

10. The coder of claim 9 further comprising adding means for adding the calculated crosscorrelations to produce autocorrelations of the synthetic filter with pitch predictions.

11. The coder of claim 10 wherein said jointly responsive means comprising second calculating means for calculating crosscorrelations between the impulse of the synthetic filter without pitch prediction and the input speech signals, and second adding means for adding the crosscorrelations calculations between the impulses of the synthetic filter with pitch prediction and the input speech signal.

12. The coder of claim 11 further comprising pulse searching means jointly responsive to said adding means and said second adding means for exciting a synthetic filter.

* * * * *